United States Patent [19]

Chang

[11] Patent Number: 4,665,472

[45] Date of Patent: May 12, 1987

[54] FAN DRAFTED LAMP

[76] Inventor: Chung-Shun Chang, P.O. Box 10160, Taipei, Taiwan

[21] Appl. No.: 880,571

[22] Filed: Jun. 30, 1986

[51] Int. Cl.[4] ..... F21V 29/00

[52] U.S. Cl. ..... 362/294; 362/373

[58] Field of Search ..... 362/294, 373, 363

[56] References Cited

U.S. PATENT DOCUMENTS

| | | | |
|---|---|---|---|
| 1,337,560 | 4/1920 | Kohn | 362/294 X |
| 1,371,936 | 3/1921 | Rubino | 362/294 X |
| 1,889,567 | 11/1932 | Persons | 362/294 X |

*Primary Examiner*—Stephen F. Husar

[57] ABSTRACT

A fan-drafted lamp includes a supporting base, a lamp fixed on a branched pipe extending from the supporting base, a fan fixed on another branched pipe and protruding from an opening of a hood portion, a power source for powering the fan and the lamp and a hood portion defining the lamp and the fan in the hood. Upon the operation of the fan, the heat radiated by the lamp will be cooled down by a ventilated air flow as drafted by the fan, so as to provide a comfortable reading surroundings under the lamp.

3 Claims, 6 Drawing Figures

FAN DRAFTED LAMP

BACKGROUND OF THE INVENTION

Conventional table lamp if installed with an incandescent bulb will radiate much heat from the lighting bulb to make a reader uncomfortable under such a lamp.

Conventional fan, either table fan or standing fan, may blow a cool air for comforting the reader under a lamp, which however still occupies an appreciated space in a living or reading room.

The present inventor has found the defects of a conventional lamp and fan, and invented the present fan-drafted lamp.

SUMMARY OF THE INVENTION

The object of the present invention is to provide a fan-drafted lamp including a supporting means, a lamp, a fan, a power source and a hood portion, wherein both the lamp and the fan are respectively mounted in the hood portion and are supported by the supporting means, so that the heat radiated from the lighting lamp may be cooled down by a ventilated air flow as drafted by the fan to provide a comfortable illuminating surroundings.

Another object of the present invention is to provide a lamp equipped with a fan for blowing on air flow to cool down the environment disposing aroung the lamp and the fan.

DETAILED DESCRIPTION

Figure 1:
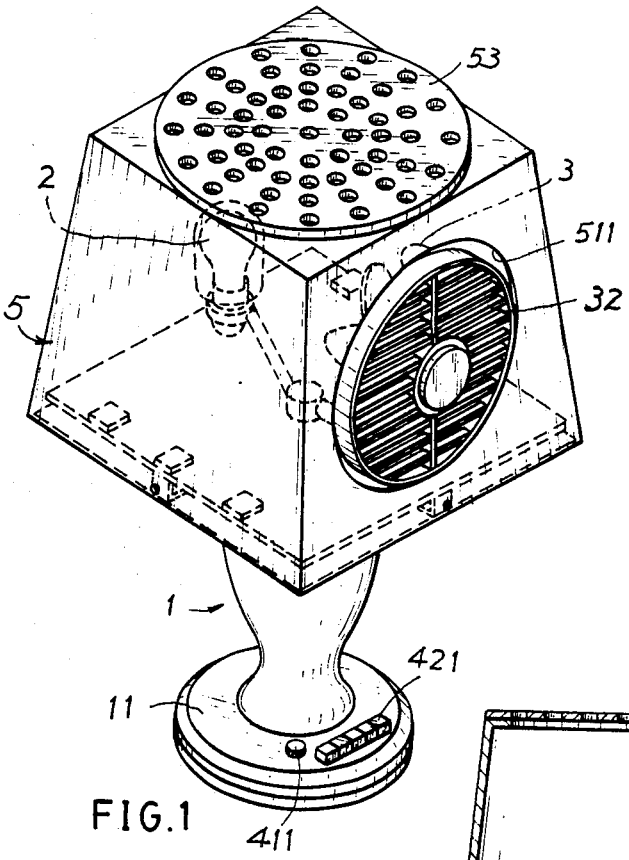
FIG. 1 is a perspective illustration of the present invention.
Figure 3:
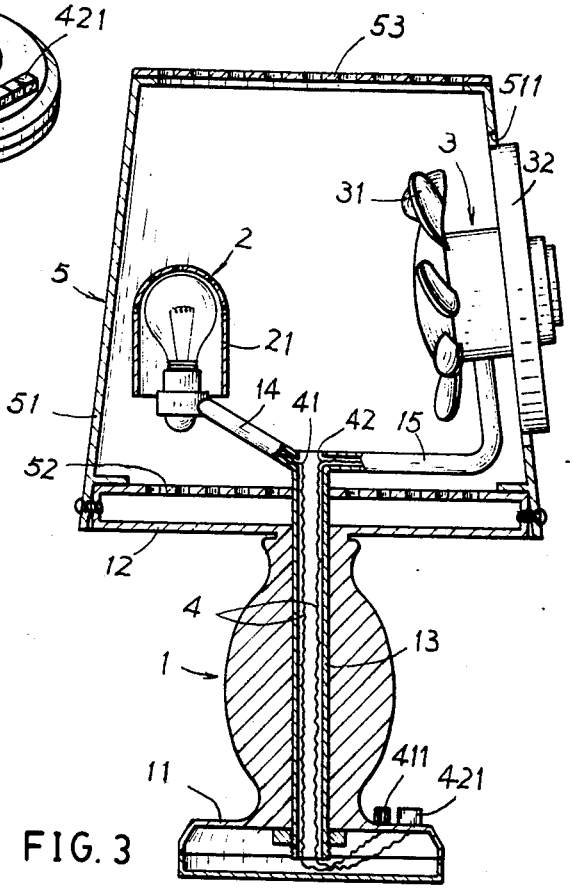
FIG. 3 is a sectional drawing of the present invention.
Figure 2:
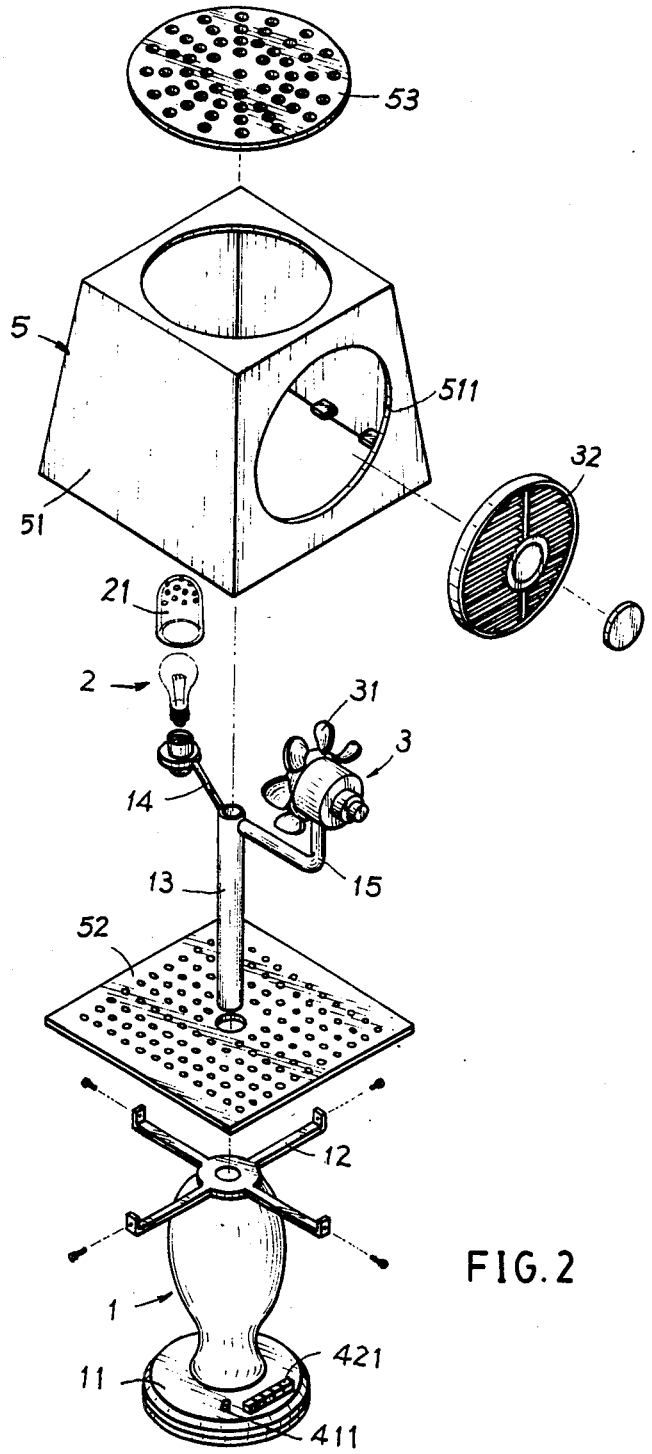
FIG. 2 is an illustration showing all parts forming the present invention.

As shown in FIGS. 1–3 and FIG. 6, the present invention comprises: a supporting means 1, a lamp 2, a fan 3, a power source 4 and a hood portion 5.

The supporting means 1 includes a base portion 11, an upper bracket 12 formed on the top end of the means 1 and a hollow pipe 13 formed on the central portion of the means 1. The hollow pipe 13 is formed with two branched pipes 14, 15 on its upper portion to respectively mount a lamp 2 and a fan 3.

The lamp 2 is electrically connected by a wire 41 of the power source 4 as controlled by a switch 411 formed on the base portion 11, whereas the fan 3 is electrically connected by another wire 42 of power source 4 as controlled by another switch 421 also formed on the base portion 11.

Figure 6:
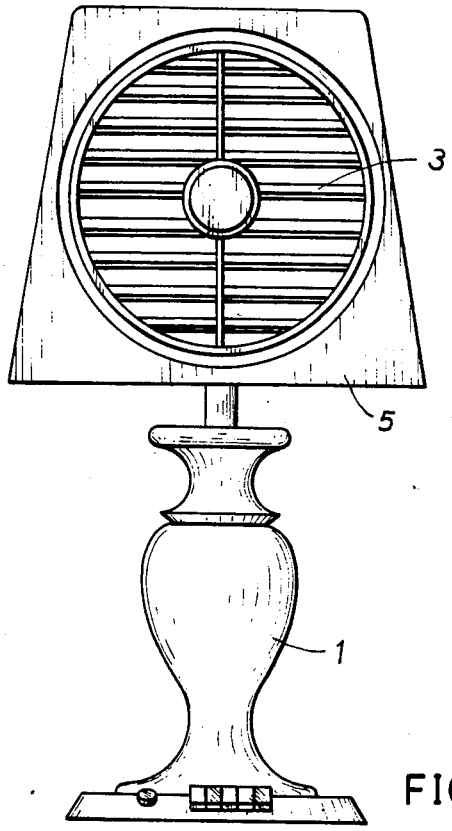
FIG. 6 shows further preferred embodiment of the present invention.

The hood portion 5, fixed on the upper bracket 12, includes a side-wall portion 51 formed as a cylinder, a truncated cone as shown in FIG. 6 or a truncated pyramid as shown in FIG. 1, a bottom perforated plate 52 and a top perforated plate 53, to define the lamp 2 and fan 3 in the hood 5.

A circular hole 511 is formed on the side-wall portion 51 for protruding a deflector 32 of the fan 3. Both top plate 53 and bottom plate 52 are respectively drilled with a plurality of holes for better ventilation or suction of air.

The lamp 2 is mounted on the first branched pipe 14 and is covered by a transparent perforated protecting shell 21 as a safety measure.

The fan 3 includes a radial impeller 31 and a deflector 32 for adjusting the air flow developed by the impeller 31.

The side-wall hood portion 5, the impeller 31 and the deflector 32 are made by translucent material to enhance the light illumination of the lamp 2. The top plate 53 and bottom plate 52 are made of transparent materials to increase their illumination effect.

The present invention has the following advantages in comparison with a conventional lamp or a fan:

1. The heat of bulb is cooled down by a ventilated air flow as drafted by the fan to provide a comfortable environmental temperature under the lamp.
2. The fan is combined with a lamp to save the space in a room.
3. In view of an esthetic meaning, the fan constructed in a lighting fixture will increase their synergetic ornamental effect.

Figure 4:
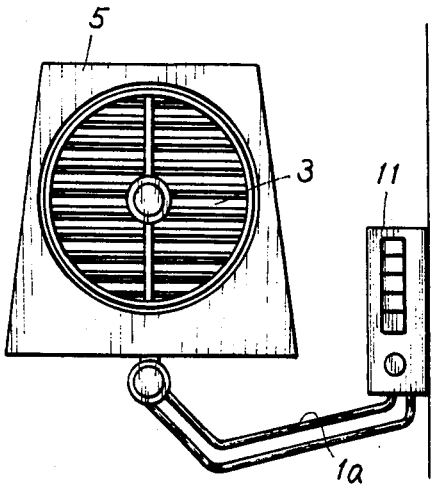
FIG. 4 shows another preferred embodiment of the present invention.

As shown in FIG. 4, the supporting means 1 may be made as a foldable, telescopic or arcuated shape or mechanism in accordance with the present invention so that the base 11 can be fixed on a wall.

Figure 5:
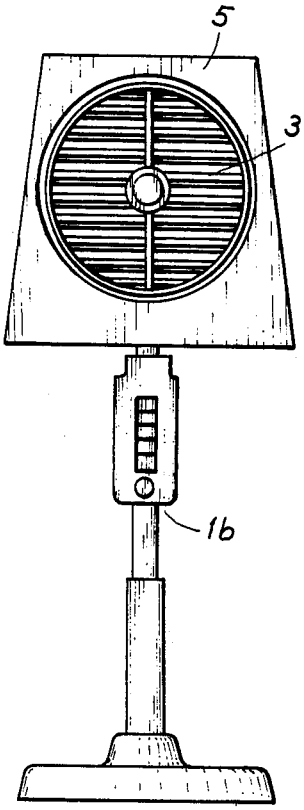
FIG. 5 shows still another preferred embodiment of the present invention.

The supporting means 1 may also be made as a stand 1*b* as shown in FIG. 5 so that the fan 3 and the lamp 2 can directly stand on a floor.

What is claimed is:

1. A fan-drafted lamp comprising:

a supporting means having a base portion, an upper bracket formed on its top portion and a central hollow pipe formed on the central portion thereof and formed as two branched pipes on the top portion of said central hollow pipe;

a lamp fixed on one said branched pipe and electrically connected to a power sounce by a wire through said central hollow pipe as controlled by a switch formed on said base portion;

a fan having a radial impeller and a deflector for adjusting the direction of an air flow as developed by the impeller, fixed on the other branched pipe, and electrically connected by another wire to the power source as controlled by the other switch formed on said base portion; and a hood portion fixed on said upper bracket and having a side-wall portion shaped as a cylinder, a truncated cone or a truncated pyramid, a top perforated plate and a bottom perforated plate to define the lamp and the fan therein, whereby upon the operation of the fan, the heat as radiated by the lamp will cooled down by a ventilated air flow as drafted by said fan.

2. A fan-drafted lamp according to claim 1, wherein the hood portion, the impeller and the deflector of the fan are preferably made of translucent materials.

3. A fan-drafted lamp according claim 1, wherein the side-wall portion of said hood portion is formed with a circular hole for protruding said deflector of said fan.

* * * * *